US007638664B2

(12) United States Patent
Peters et al.

(10) Patent No.: US 7,638,664 B2
(45) **Date of Patent: *Dec. 29, 2009**

(54) HYDROCARBON CONVERSION PROCESS INCLUDING A STAGGERED-BYPASS REACTION SYSTEM

(75) Inventors: Kenneth D. Peters, Des Plaines, IL (US); Clayton C. Sadler, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/260,312

(22) Filed: Oct. 29, 2008

(65) Prior Publication Data

US 2009/0054712 A1 Feb. 26, 2009

Related U.S. Application Data

(62) Division of application No. 11/615,254, filed on Dec. 22, 2006.

(51) Int. Cl.
*C07C 2/00* (2006.01)

(52) U.S. Cl. ..... 585/310; 585/314; 585/441; 585/449; 208/49; 208/64; 208/79; 208/80; 208/133; 208/134; 208/142; 208/145; 208/156; 208/165; 208/169

(58) Field of Classification Search ..... 208/49, 208/64, 79, 80, 133, 134, 142, 145, 156, 208/165, 169; 585/310, 314, 441, 449
See application file for complete search history.

(56) References Cited

U.S. PATENT DOCUMENTS

| | | | | |
|---|---|---|---|---|
| 3,853,745 | A | 12/1974 | Welty, Jr. | 208/139 |
| 4,104,149 | A | 8/1978 | Veinerman et al. | 208/64 |
| 4,119,526 | A | 10/1978 | Peters et al. | 208/64 |
| 4,119,527 | A | 10/1978 | Peters | 208/64 |
| 4,325,806 | A * | 4/1982 | Peters | 208/64 |
| 4,325,807 | A | 4/1982 | Peters | 208/64 |
| 4,348,271 | A | 9/1982 | Swan | 208/89 |
| 4,354,925 | A | 10/1982 | Schorfheide | 208/140 |
| 4,406,775 | A | 9/1983 | Bailor et al. | 208/140 |
| 4,406,777 | A | 9/1983 | Melconian | 208/156 |
| 4,411,869 | A | 10/1983 | Kroushl et al. | 422/188 |
| 4,411,870 | A | 10/1983 | Kroushl et al. | 422/188 |
| 4,425,222 | A | 1/1984 | Swan | 208/65 |
| 4,427,533 | A | 1/1984 | Swan | 208/65 |
| 4,436,612 | A | 3/1984 | Oyekan et al. | 208/65 |
| 4,440,626 | A | 4/1984 | Winter et al. | 208/65 |
| 4,440,627 | A | 4/1984 | Markley | 208/65 |
| 5,879,537 | A * | 3/1999 | Peters | 208/134 |
| 2005/0274648 | A1 | 12/2005 | Goldstein et al. | 208/134 |

* cited by examiner

*Primary Examiner*—In Suk Bullock
*Assistant Examiner*—Prem C. Singh
(74) *Attorney, Agent, or Firm*—Maryann Maas

(57) ABSTRACT

One exemplary embodiment can include a hydrocarbon conversion process. Generally, the process includes passing a hydrocarbon stream through a hydrocarbon conversion zone comprising a series of reaction zones. Typically, the hydrocarbon conversion zone includes a staggered-bypass reaction system having a first, second, third, and fourth reaction zones, which are staggered-bypass reaction zones, and a fifth reaction zone, which can be a non-staggered-bypass reaction zone, subsequent to the staggered-bypass reaction system.

4 Claims, 1 Drawing Sheet

HYDROCARBON CONVERSION PROCESS INCLUDING A STAGGERED-BYPASS REACTION SYSTEM

CROSS-REFERENCE TO RELATED APPLICATION

This application is a Division of copending application Ser. No. 11/615,254 filed Dec. 22, 2006, the contents of which are hereby incorporated by reference in its entirety.

FIELD OF THE INVENTION

The field of this invention generally relates to a hydrocarbon conversion process in multiple reaction zones.

BACKGROUND OF THE INVENTION

Hydrocarbon conversion processes often employ multiple reaction zones through which hydrocarbons pass in series flow. Each reaction zone in the series often has a unique set of design requirements. Generally, one such design requirement of each reaction zone in the series is a hydraulic capacity, which can be the maximum throughput of hydrocarbons through that zone. An additional design requirement of each reaction zone is the capability to perform a specified degree of hydrocarbon conversion. Designing a reaction zone for a specified degree of hydrocarbon conversion, however, often results in a reaction zone that can be designed larger than the minimum size required for hydraulic capacity alone. Consequently, in hydrocarbon conversion processes having multiple reaction zones with a series flow of hydrocarbons, one reaction zone may have more hydraulic capacity than some other reaction zones in the series. As an example, in a hydrocarbon reforming process, the penultimate and/or last reforming reaction zone often has excess hydraulic capacity in comparison with the first and/or second reforming reaction zone.

One solution to these shortcomings is providing staggered-bypass reactors to eliminate hydraulic capacity constraints, as a result of, e.g., catalyst pinning, from one or more reactors in a process, such as a catalytic reforming process. Generally, in catalytic reforming the catalyst circulates from a series of reaction zones to a regenerator and then returns to the first zone. Additional advantages of staggered-bypass reactors can include eliminating bottlenecks in other equipment, such as fired heaters or recycle gas compressors.

However, a shortcoming of staggered-bypass reactors is that the overall catalyst utilization is somewhat reduced because not all the hydrocarbons pass through all the reactors. To obtain the same conversion with a reactor section using staggered-bypass reactors, generally the reactor inlet temperatures are increased somewhat higher than the reactor inlet temperatures required without the bypassing. In units using larger bypassing flow rates, such as greater than about 15%, the resultant temperature increase may limit the increased feed rate or increased reformate octane potential of the unit because the existing equipment is limited with respect to the temperatures or pressures created by the higher temperatures. Desirably, it would be beneficial to overcome this limitation in a unit having staggered-bypass reactors. Although staggered-bypass reactors can eliminate the problems associated with hydraulic capacity restraints, increasing the feed rates through the reactors without having to increase the temperature would be desired.

BRIEF SUMMARY OF THE INVENTION

One exemplary embodiment can include a hydrocarbon conversion process. Generally, the process includes passing a hydrocarbon stream through a hydrocarbon conversion zone comprising a series of reaction zones. Typically, the hydrocarbon conversion zone includes a staggered-bypass reaction system having a first, second, third, and fourth reaction zones, which are staggered-bypass reaction zones, and a fifth reaction zone, which can be a non-staggered-bypass reaction zone, subsequent to the staggered-bypass reaction system.

Another exemplary embodiment can include a process for optimizing a staggered-bypass reaction system. The staggered-bypass reaction system can include a plurality of staggered-bypass reaction zones. Generally, the process includes adding a non-staggered-bypass reaction zone having a feed consisting of an effluent from the last staggered-bypass reaction zone of the plurality of staggered-bypass reaction zones.

A further embodiment may include a hydrocarbon conversion process. The hydrocarbon conversion process generally includes passing a hydrocarbon stream through a hydrocarbon conversion zone. Typically, the hydrocarbon conversion zone includes a staggered-bypass reaction system, having first, second, third, and fourth staggered-bypass reaction zones, and a fifth non-staggered-reaction zone receiving a feed consisting of an effluent from the fourth staggered-bypass reaction zone.

Typically, the embodiments disclosed herein provide several advantages for a reaction system or unit having staggered-bypasses. Particularly, the addition of a new reactor to a hydrocarbon conversion unit can help maximize the potential for both increased feed rate and increased reformate, octane, and aromatics production. The existing catalyst pinning, design, temperature, and pressure limitations associated at least with the equipment of the unit can be overcome. Particularly, the modification can allow utilization of fired heaters, reactors, piping, and the recycle gas compressor at higher unit throughputs that would otherwise not be feasible due to catalyst pinning, and equipment design pressure, recycle gas compressor head, fired heater maximum tube-wall temperatures, and fired heater draft limitations.

Moreover, the additional reactor can eliminate bottlenecks in individual fired heater cells because adding the reactor can also include adding a heater cell associated with the reactor. In addition, the added reactor may allow for debottlenecking of the recycle compressor, because the overall reactor section pressure can drop due to the reduced flow rate of material through the main portion of the unit.

What is more, staggered-bypasses with the addition of a new reactor may enable the increased utilization of catalyst in existing reactors. Particularly, if an increased throughput is desired through the hydrocarbon conversion unit, generally the temperature of the existing reactors is increased. But as discussed above, certain equipment may not be suited for the increased temperatures. As a consequence, not all of the catalyst in the reactors can be utilized. Adding a new reactor permits the exploitation of catalyst in the existing reactors. This feature is particularly advantageous for an existing unit being modified to handle increased throughput.

In summary, the unused capacity created from initiating staggered-bypassing in an operating unit may create a disadvantage of not utilizing all of the catalyst. But the embodiments disclosed herein can provide a mechanism for utilizing all existing catalyst volume and take full advantage of the staggered bypassing.

BRIEF DESCRIPTION OF THE DRAWING

The drawing is a schematic flow diagram of an exemplary hydrocarbon conversion zone.

DEFINITIONS

Figure 1:
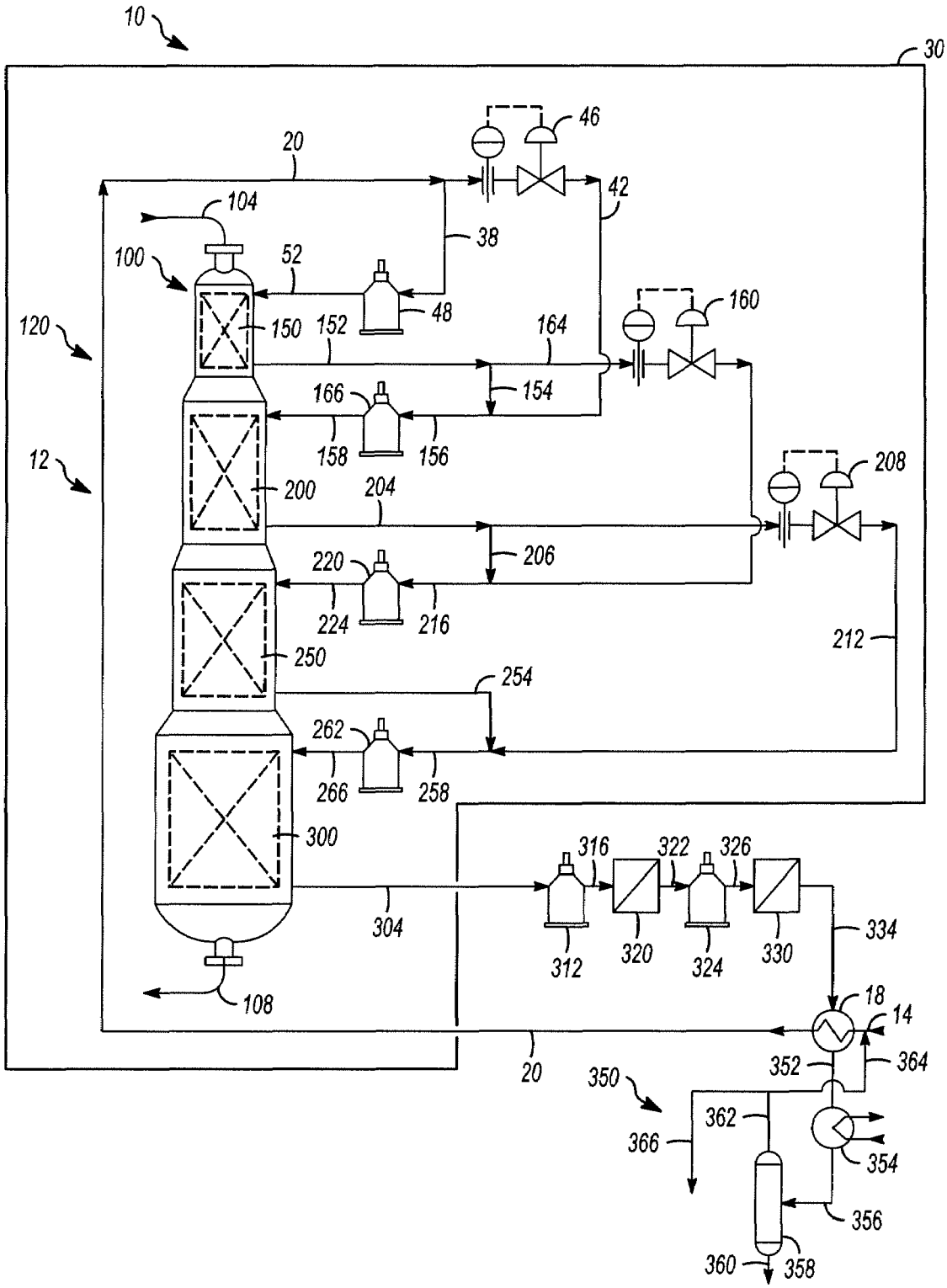

As used herein, a staggered-bypass reaction zone is a reaction zone that can have a portion of its feed being an effluent from a previous reaction zone combined with hydrocarbons that bypassed the previous reaction zone that provided the effluent or a portion of its effluent split prior to being combined with hydrocarbons that bypass the reaction zone that produce the effluent.

As used herein, a "non-staggered-bypass reaction zone" is a reaction zone that is not a staggered-bypass reaction zone. An exemplary non-staggered-bypass reaction zone may be a reaction zone that does not have its effluent split and has a feed consisting of an effluent from the previous reaction zone. It should be understood that a non-staggered-bypass reaction zone may receive some hydrocarbons that bypassed a previous reaction zone or not receive all the effluent from a previous reactor.

As used herein, the term "zone" can refer to an area including one or more equipment items and/or one or more sub-zones. Additionally, an equipment item, such as a reactor or vessel, can further include one or more zones or sub-zones.

DETAILED DESCRIPTION OF THE INVENTION

A wide variety of hydrocarbon conversion processes can include multiple reaction zones. Exemplary hydrocarbon conversion processes include at least one of reforming, alkylating, de-alkylating, hydrogenating, hydrotreating, dehydrogenating, isomerizing, dehydroisomerizing, dehydrocyclizing, cracking, and hydrocracking processes. Catalytic reforming may be referenced hereinafter in the embodiment depicted in the drawing.

Referring to FIG. 1, an exemplary hydrocarbon conversion zone 10 is depicted with the shown equipment generally not drawn to scale. The hydrocarbon conversion zone 10 can include a series of reaction zones 12, including at least some of these zones in a staggered-bypass reaction system 30. The staggered-bypass reaction system 30 is known to those of skill in the art and one exemplary staggered-bypass reaction system 30 is disclosed in U.S. Pat. No. 5,879,537 (Peters), which is hereby incorporated by reference in its entirety. As such, the hydrocarbon flows through this system 30 will be described schematically.

Generally, a hydrocarbon stream enters through a line 14. The hydrocarbon stream can pass through a combined feed/effluent heat exchanger 18 and subsequently pass as a feed to the staggered-bypass reaction system 30 through a line 20.

The staggered-bypass reaction system 30 can include a vessel 100 having a stacked reactor arrangement 100, which can include a plurality of staggered-bypass zones 120, namely a first reaction zone 150, a second reaction zone 200, a third reaction zone 250, and a fourth reaction zone 300. Desirably, the vessel 100 is a moving bed reactor that receives regenerated catalyst through a line 104 and discharges spent catalyst through a line 108 to a regeneration zone. Alternatively, the staggered-bypass reaction system 30 can include side-by-side moving bed reactors containing one or more reaction zones.

Usually, the hydrocarbon stream enters the staggered-bypass reaction system 30 through the line 20. Subsequently, the hydrocarbon stream may be split with a feed heading to the first reaction zone 150 by passing through a line 38 while a portion can be bypassed through a line 42 as regulated by a control valve 46. Generally, the feed proceeds through the line 38 to a furnace 48 and then through a line 52 to the first reaction zone 150. Next, an effluent from the first reaction zone 150 can travel through a line 152 and be split. Particularly, another portion of the first reaction zone effluent can be sent through a line 154 to be combined with the portion bypassed around the first reaction zone 150 in the line 42. Afterwards, the combined stream in a line 156 is usually heated in a furnace 166 before entering a line 158 into the second reaction zone 200. As such, the second reaction zone 200 typically receives as a feed in the line 158 an effluent from the first reaction zone 150 as well as the portion of the hydrocarbon stream that was bypassed around the first reaction zone 150. In addition, the first reaction zone 150 may have a portion of its effluent bypassed around the second reaction zone 200 in a line 164 as controlled by a valve 160.

Generally, the effluent from the second reaction zone 200 exits through a line 204 and a part is bypassed through a line 212 around the third reaction zone 250 by regulating a control valve 208 with another portion routed through a line 206 to be combined with the portion that was bypassed around the second reaction zone 200 in the line 164. Thus, a combined stream in a line 216 can include the effluent from the second reaction zone 200 and a portion that can be bypassed around the second reaction zone 200. Usually, this combined stream is heated in a furnace 220 and passes through a line 224 before entering the third reaction zone 250.

Next, an effluent from the third reaction zone 250 can pass through a line 254. This effluent in the line 254 may be combined with a portion that was bypassed around the third reaction zone 250 in the line 212. Generally, the combined stream in the line 258 is heated in a furnace 262 and travels through a line 266 before entering the fourth reaction zone 300. In this exemplary embodiment, the fourth reaction zone 300 is the last reaction zone of the plurality of staggered-bypass zones 120. That being done, an effluent from the fourth reaction zone 300 may enter a line 304 and exit the staggered-bypass reaction system 30.

The effluent from the fourth reaction zone 300 can pass through the line 304 to a furnace 312 and a line 316 to enter a fifth reaction zone or first non-staggered-bypass reaction zone 320. This reaction zone 320 can be incorporated into a fixed bed reactor or a moving bed reactor. Such reactors are known. Exemplary fixed bed reactors are disclosed in US Pub. No. 2004/0129605A1 (Goldstein et al.), and U.S. Pat. No. 3,864,240 (Stone). Exemplary moving bed reactors are disclosed in U.S. Pat. No. 4,119,526 (Peters et al.) and U.S. Pat. No. 4,409,095 (Peters). In one exemplary embodiment, a single additional reaction zone 320 is sufficient. However, it should be understood that any number of additional reaction zones can be added.

Optionally, an effluent from the fifth reaction zone 320 can travel through a line 322 to a furnace 324 and subsequently pass through a line 326. After exiting the line 326, the effluent from the fifth reaction zone 320 can enter as a feed to a sixth reaction zone or second non-staggered-bypass reaction zone 330. Both the fifth reaction zone 320 and the sixth reaction zone 330 may receive all the effluent from the previous reaction zone, although in some contemplated embodiments these zones 320 and 330 may only receive a portion from or a portion bypassed around the previous reaction zone. Also, these reaction zones 320 and 330 are depicted as being separate zones, however, it should be understood that these additional non-staggered-bypass reaction zones can be in a stacked reactor arrangement in a single vessel. Moreover, it should be understood that these reaction zones can be incorporated in any suitable reaction vessel.

After exiting the sixth reaction zone 330, an effluent from the sixth reaction zone 334 can then pass through the combined feed/effluent heat exchanger 18 to heat the incoming hydrocarbon stream in the line 14.

Subsequently, the effluent can enter the product separation zone 350, which is disclosed in, e.g., U.S. Pat. No. 5,879,537 (Peters) by passing through a line 352, a cooler 354 and a line 356. Afterwards, this hydrocarbon stream can pass to a separator 358, where a reformate product can exit through a line 360 and light gases can exit through a line 362. Generally, the light gasses contain light hydrocarbons and hydrogen. A portion of these light hydrocarbon compounds and hydrogen can be sent to a hydrogen recovery facility through a line 366 and the remainder can be recycled through a line 364 to the hydrocarbon stream 14. Although not depicted, it should be understood that additional hydrogen could be supplied through other lines to the hydrocarbon stream 14.

Typically, the reaction zone inlet temperatures are, independently, about 450—about 560° C. (about 840—about 1040° F.) and the reaction zone pressures are, independently, about 2.1—about 14 kg/cm$^2$(g) (about 30—about 200 psi(g)) for the hydrocarbon conversion zone 10.

In one exemplary embodiment, the effluent from the fourth reaction zone 300 traveling in the line 304 can be at a temperature of about 490° C. (about 910° F.) at a mass flow rate of about 270,000 kg/hr (600,000 lb/hr). In addition, the temperature of the effluent exiting the furnace 312 and the line 316 can be about 540° C. (about 1,000° F.). The effluent exiting the fifth reaction zone 320 can be at a temperature of about 510° C. (about 950° F.) Typically, the effluent would leave the fourth reaction zone 300 at about the same mass flow as the fifth reaction zone 320 and the sixth reaction zone 330.

Generally, the embodiments disclosed herein can allow an existing staggered-bypass reaction system to fully utilize the existing catalyst volume in its zones by adding one or more additional reaction zones. The embodiments can be particularly suited for modifying an existing staggered-bypass system by increasing the system's performance by allowing higher throughputs and greater conversion of hydrocarbons.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth uncorrected in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for optimizing a staggered-bypass reaction system, comprising a plurality of moving bed staggered-bypass reaction zones, comprising:

adding a non-staggered non-bypass fixed bed reaction zone having a feed consisting of an effluent from the last staggered-bypass reaction zone of the plurality of staggered-bypass reaction zones.

2. A process according to claim 1, wherein the moving bed staggered-bypass reaction system comprises first, second, and third staggered-bypass moving bed reaction zones.

3. A process according to claim 1, further comprising a second non-staggered-non-bypass reaction zone having a feed consisting of an effluent from the first non-staggered-non-bypass reaction zone.

4. A hydrocarbon conversion process, comprising:

passing a hydrocarbon stream through a hydrocarbon conversion zone, which in turn comprises:

i) a staggered-bypass moving bed reaction system, comprising first, second, third, and fourth staggered-bypass moving bed reaction zones; and ii) a fifth non-staggered non-bypass fixed bed reaction zone receiving a feed consisting of an effluent from the fourth staggered-bypass reaction zone.

* * * * *